US008902143B2

(12) United States Patent
Yoshinaga et al.

(10) Patent No.: US 8,902,143 B2
(45) Date of Patent: Dec. 2, 2014

(54) LIQUID CRYSTAL DISPLAY FOR DRIVING A PIXEL WITH A BLACK STATE AND A WHITE STATE WITHIN ONE FRAME PERIOD, METHOD OF DRIVING THE SAME AND ELECTRONIC UNIT INCLUDING THE SAME

(75) Inventors: Tomoro Yoshinaga, Kanagawa (JP); Tsuyoshi Okazaki, Kanagawa (JP)

(73) Assignee: Sony Corporation, Tokyo (JP)

( * ) Notice: Subject to any disclaimer, the term of this patent is extended or adjusted under 35 U.S.C. 154(b) by 121 days.

(21) Appl. No.: 13/610,415

(22) Filed: Sep. 11, 2012

(65) Prior Publication Data

US 2013/0069995 A1 Mar. 21, 2013

(30) Foreign Application Priority Data

Sep. 21, 2011 (JP) ..... 2011-205987

(51) Int. Cl.
*G09G 3/36* (2006.01)
*G09G 3/32* (2006.01)

(52) U.S. Cl.
CPC ..... *G09G 3/3225* (2013.01); *G09G 2310/0251* (2013.01); *G09G 2310/0248* (2013.01); *G09G 2320/0257* (2013.01); *G09G 2320/0238* (2013.01); *G09G 2300/0426* (2013.01); *G09G 2310/0262* (2013.01)
USPC ..... 345/89; 345/690

(58) Field of Classification Search
CPC ..... G09G 2320/0276; G09G 3/3648; G09G 3/3607
USPC ..... 345/690, 89
See application file for complete search history.

(56) References Cited

U.S. PATENT DOCUMENTS

2006/0187176 A1* 8/2006 Yang ..... 345/100
2007/0273628 A1* 11/2007 Sato et al. ..... 345/87
2008/0158119 A1* 7/2008 Park et al. ..... 345/87

FOREIGN PATENT DOCUMENTS

JP 2002-357830 12/2002

* cited by examiner

*Primary Examiner* — Long D Pham
(74) *Attorney, Agent, or Firm* — K&L Gates LLP

(57) ABSTRACT

A liquid crystal display includes: a display section including a plurality of pixels and displaying an image through varying a gray scale of each of the pixels based on an image signal; a detection section detecting, based on the image signal, variations in gray scales of a first pixel and a second pixel which are adjacent to each other; and a control section performing control, based on a detection result of the detection section, to allow one of the first and second pixels to be maintained in black state of display for a predetermined period.

6 Claims, 14 Drawing Sheets

LIQUID CRYSTAL DISPLAY FOR DRIVING A PIXEL WITH A BLACK STATE AND A WHITE STATE WITHIN ONE FRAME PERIOD, METHOD OF DRIVING THE SAME AND ELECTRONIC UNIT INCLUDING THE SAME

BACKGROUND

The present disclosure relates to a liquid crystal display performing display in, for example, a VA (Vertical Alignment) mode, and a method of driving the same, and an electronic unit including such a liquid crystal display.

In liquid crystal displays, when an electric field is applied to a liquid crystal layer sandwiched between two substrates facing each other, alignment of liquid crystal molecules in the liquid crystal layer is changed to modulate light passing through the liquid crystal layer. Systems of applying an electric field to a liquid crystal layer include a vertical electric field system. In the vertical electric field system, a pixel electrode and a counter electrode are disposed to face each other with the liquid crystal layer in between, and an electric field is applied, in a vertical direction, to liquid crystal molecules between the pixel electrode and the counter electrode. Display modes using the vertical electric field system include a VA mode and a MVA (Multi-domain Vertical Alignment) mode (refer to Japanese Unexamined Patent Application Publication No. 2002-357830). In liquid crystal displays of these modes, liquid crystal molecules are aligned at a predetermined pre-tilt angle in a vertically oblique direction, and in a usual state (an off state) in which an electric field is not applied to the liquid crystal layer, long axes of liquid crystal molecules are aligned in a direction substantially perpendicular to a substrate surface. In a state (an on state) in which an electric field is applied to the liquid crystal layer, liquid crystal molecules fall (tilt) according to the magnitude of the electric field to be aligned in a direction nearly parallel (horizontal) to the substrate surface.

SUMMARY

In the above-described liquid crystal displays, when adjacent pixels display different gray scales, different drive voltages are applied to adjacent pixel electrodes, respectively. In this case, an electric field may be generated in a transverse direction between the adjacent pixel electrodes to cause alignment perturbation of liquid crystal molecules, thereby causing a decline in image quality. For example, unintended afterimage may be generated during display of a moving picture.

It is desirable to provide a liquid crystal display capable of suppressing alignment perturbation of liquid crystal molecules during display of a moving picture and displaying a moving picture with less afterimage, a method of driving the same, and an electronic unit.

According to an embodiment of the disclosure, there is provided a liquid crystal display including: a display section including a plurality of pixels and displaying an image through varying a gray scale of each of the pixels based on an image signal; a detection section detecting, based on the image signal, variations in gray scales of a first pixel and a second pixel which are adjacent to each other; and a control section performing control, based on a detection result of the detection section, to allow one of the first and second pixels to be maintained in black state of display for a predetermined period.

According to an embodiment of the disclosure, there is provided a method of driving a liquid crystal display, the liquid crystal display including a display section including a plurality of pixels and displaying an image through varying a gray scale of each of the pixels based on an image signal; the method including: detecting, based on the image signal, variations in gray scales of a first pixel and a second pixel which are adjacent to each other; and performing control, based on a detection result on variations in gray scale, to allow one of the first and second pixels to be maintained in black state of display for a predetermined period.

According to an embodiment of the disclosure, there is provided an electronic unit including a liquid crystal display, the liquid crystal display including: a display section including a plurality of pixels and displaying an image through varying a gray scale of each of the pixels based on an image signal; a detection section detecting, based on the image signal, variations in gray scales of a first pixel and a second pixel which are adjacent to each other; and a control section performing control, based on a detection result of the detection section, to allow one of the first and second pixels to be maintained in black state of display for a predetermined period.

In the liquid crystal display, the method of driving the same, and the electronic unit according to the embodiments of the disclosure, variations in gray scales of the first pixel and the second pixel which are adjacent to each other are detected, and one of the first and second pixels is controlled, based on the detection result on the variations in gray scale, to be maintained in black state of display for a predetermined period.

In the liquid crystal display, the method of driving the same, and the electronic unit according to the embodiments of the disclosure, one of the first and second adjacent pixels is controlled, based on the variations in gray scale, to be maintained in black state of display for a predetermined period; therefore, alignment perturbation of liquid crystal molecules during display of a moving picture is allowed to be suppressed, and a moving picture are allowed to be displayed with less afterimage.

Additional features and advantages are described herein, and will be apparent from the following Detailed Description and figures.

BRIEF DESCRIPTION OF THE FIGURES

The accompanying drawings are included to provide a further understanding of the technology, and are incorporated in and constitute a part of this specification. The drawings illustrate embodiments and, together with the specification, serve to explain the principles of the technology.

DETAILED DESCRIPTION

Preferred embodiments of the disclosure will be described in detail below referring to the accompanying drawings.

First Embodiment

Configuration of Liquid Crystal Display

Figure 1:
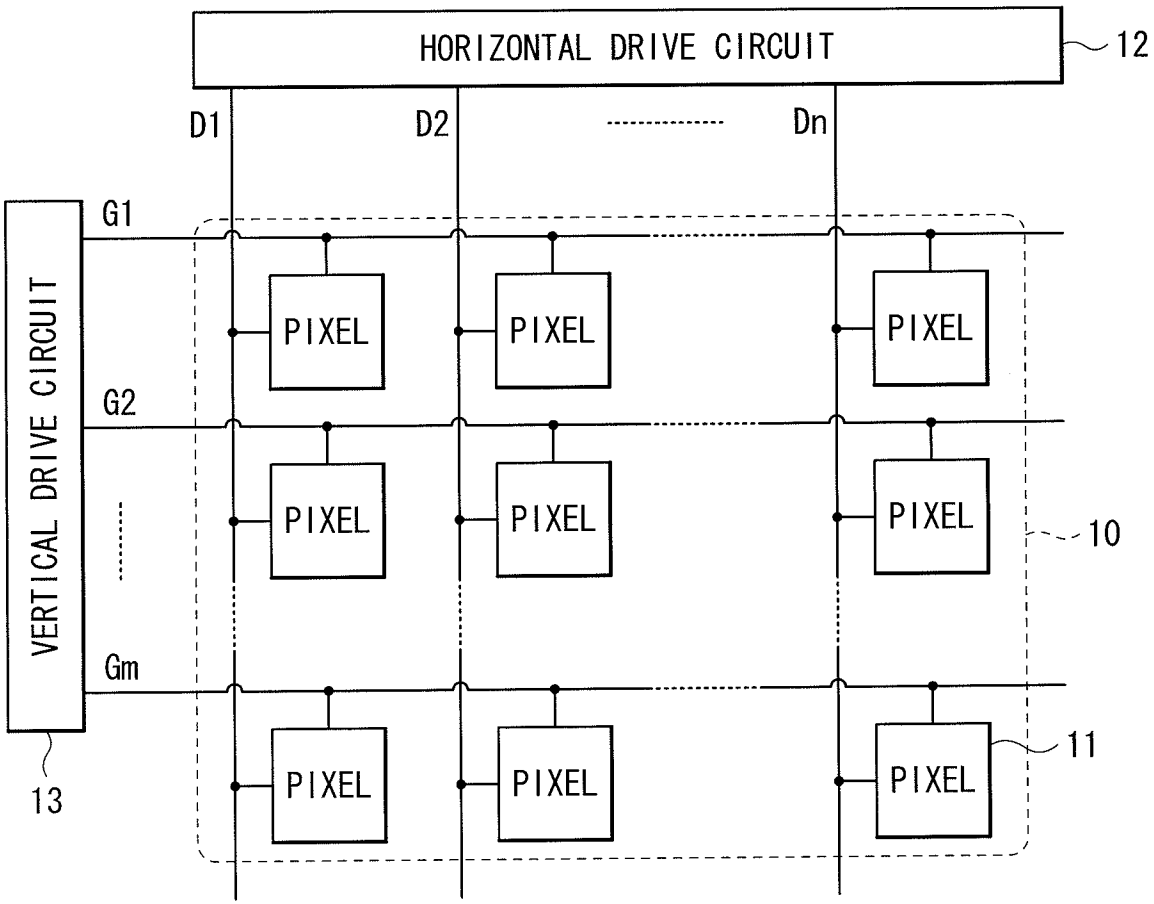
FIG. 1 is a block diagram illustrating a configuration example of a liquid crystal display according to a first embodiment of the disclosure.

FIG. 1 illustrates a configuration example of a liquid crystal display according to a first embodiment of the disclosure. The liquid crystal display includes a display region (a display section) 10 including a plurality of pixels 11, a horizontal drive circuit 12 and a vertical drive circuit 13 which are disposed around the display region 10, a plurality of data lines D1, D2, . . . , Dn, and a plurality of gate lines G1, G2, . . . , Gm.

The horizontal drive circuit 12 supplies, in a horizontal direction, image data signals (gray-scale signals) based on an image signal to the plurality of pixels 11 through the plurality of data lines D1, D2, . . . , Dn arranged in parallel in the horizontal direction. The vertical drive circuit 13 supplies, in a vertical direction, a gate signal (a scanning signal) to the plurality of pixels 11 through the plurality of gate lines G1, G2, . . . , Gm arranged in parallel in the vertical direction.

The plurality of pixels 11 are arranged in a matrix at intersections of the plurality of data lines D1, D2, . . . , Dn and the plurality of gate line G1, G2, . . . , Gm. Thus, the pixel 11 to which the gate signal and image data signal are supplied is driven.

Figure 2A:
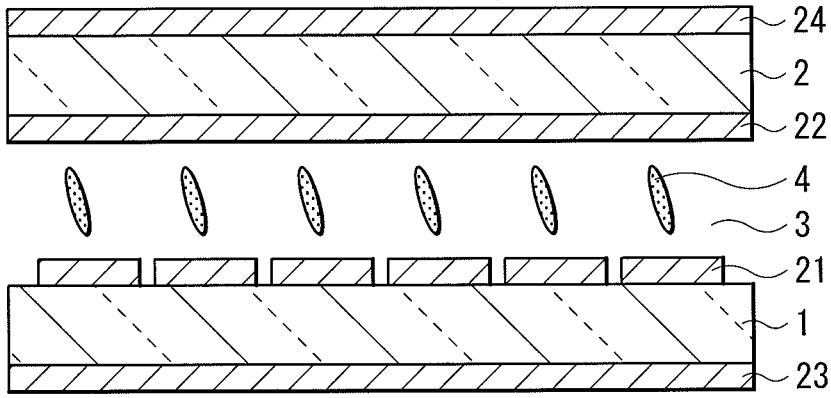
FIGS. 2A and 2B are sectional views illustrating an example of a sectional configuration of the liquid crystal display according to the first embodiment.
Figure 2B:
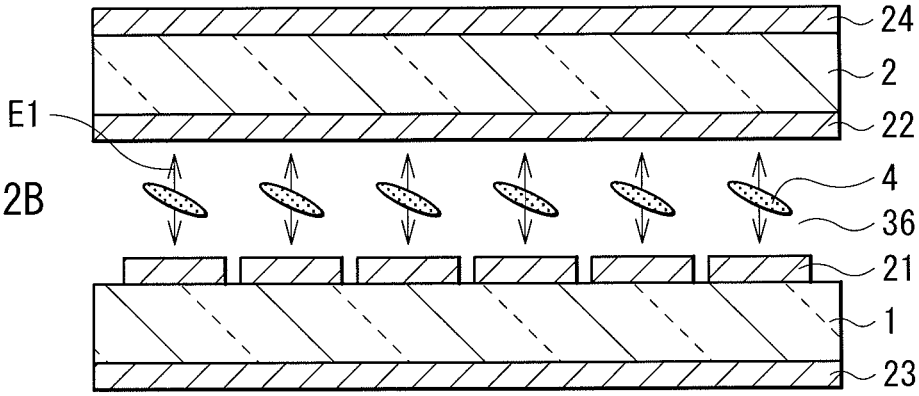

For example, as illustrated in FIGS. 2A and 2B, the plurality of pixels 11 have a configuration of a liquid crystal display panel operating in a VA mode. The liquid crystal display panel has a configuration in which a liquid crystal layer 3 is sandwiched between a pixel substrate 1 and a counter substrate 2, and the pixel substrate 1 and the counter substrate 2 are sandwiched between a first polarizing plate 23 and a second polarizing plate 24.

A plurality of pixel electrodes 21 corresponding to the plurality of pixels 11 are disposed on a surface closer to the liquid crystal layer 3 of the pixel substrate 1. An alignment film (not illustrated) is formed on surfaces of the plurality of pixel electrodes 21. The counter electrode 22 is disposed on a substantially entire portion corresponding to the display region 10 of a surface closer to the liquid crystal layer 3 of the counter substrate 2. An alignment film (not illustrated) is formed on a surface of the counter electrode 22. The pixel substrate 1 and the counter substrate 2 are made of, for example, a transparent glass material. The pixel electrodes 21 and the counter electrode 22 each are made of, for example, a transparent conductive film of ITO (indium tin oxide) or the like.

Wiring for driving the plurality of pixel electrodes 21 (the plurality of data lines D1, D2, . . . , Dn and the plurality of gate lines G1, G2, . . . , Gm), TFTs (thin film transistors), and the like are also disposed on the pixel substrate 1.

The liquid crystal layer 3 includes vertical alignment type liquid crystal molecules 4. In the liquid crystal layer 3, the liquid crystal molecules 4 each have a rotationally symmetrical shape with respect to a long axis and a short axis as central axes, and exhibit negative dielectric constant anisotropy (a property in which a dielectric constant in a long-axis direction is smaller than that in a short-axis direction).

Figure 3:
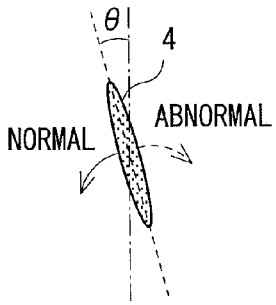
FIG. 3 is an explanatory diagram of an alignment direction of liquid crystal molecules.

The liquid crystal molecules 4 are aligned at a predetermined pre-tilt angle θ in a vertically oblique direction (refer to FIG. 3). As illustrated in FIG. 2A, in a usual state (an off state) in which an electric field E1 is not applied to the liquid crystal layer 3, the long-axis direction of the liquid crystal molecules 4 is aligned in a direction substantially perpendicular to a substrate surface. On the other hand, as illustrated in FIG. 2B, in a state (an on state) in which the electric field E1 is applied, in a vertical direction, to the liquid crystal layer 3, the liquid crystal molecules 4 fall (tilt) according to the magnitude of the electric field E1 to be aligned in a direction nearly parallel (horizontal) to the substrate surface.

It is to be noted that, when the electric field E1 is applied, in the vertical direction, to the liquid crystal layer 3, as illustrated in FIG. 3, in a normal state, the liquid crystal molecules 4 fall in the same direction as a direction of the pre-tilt angle θ, but in an abnormal state, the liquid crystal molecules 4 fall in a direction opposite to the direction of the pre-tilt angle θ due to, for example, a transverse electric field E2 (refer to FIG. 7) which will be described later, and the abnormal state is a major cause of unintended alignment perturbation.

The first polarizing plate 23 and the second polarizing plate 24 are arranged in a crossed Nicol state, and, for example, when light from a backlight (not illustrated) enters the first polarizing plate 23 and the second polarizing plate 24, in the usual state (refer to FIG. 2A), the first polarizing plate 23 and the second polarizing plate 24 block the light, and in a state in which the electric field E1 is applied (refer to FIG. 2B), the first polarizing plate 23 and the second polarizing plate 24 allow an amount of light according to the magnitude of the electric field E1 to pass therethrough. Thus, when the electric field E1 is applied to the liquid crystal layer 3, alignment of liquid crystal molecules in the liquid crystal layer is changed to modulate light passing through the liquid crystal layer. The liquid crystal display is normally maintained in black state of display. In other words, the liquid crystal display operates in a so-called normally black display mode.

(Configuration of Control Circuit for Image Quality Improvement)

The liquid crystal display includes a control circuit illustrated in FIG. 4 to suppress alignment perturbation of liquid crystal molecules during display of a moving picture and to display a moving picture with less afterimage, as will be described later. The control circuit includes a gray-scale differential detection section 31, a black-insertion instruction section 32, an alignment-direction data storage section 33, a drive control section 34.

The gray-scale differential detection section 31 detects, based on a supplied image signal Vin, variations in gray scales of a first pixel and a second pixel which are adjacent to each other. The alignment-direction data storage section 33 holds information of the direction of the pre-tilt angle θ of the liquid crystal molecules 4 in respective pixels 11.

The black-insertion instruction section 32 corrects an image signal, based on a detection result of the gray-scale differential detection section 31, to allow one of the first and the second adjacent pixels in the plurality of pixels 11 to be maintained in black state of display for a predetermined period. Moreover, the black-insertion instruction section 32 corrects an image signal Vin in consideration of information of the direction of the pre-tilt angle θ from the alignment-direction data storage section 33. Although a specific example will be described later, when it is indicated that alignment perturbation of liquid crystal molecules 4 in a direction opposite to the direction of the pre-tilt angle θ is likely to be caused in a region near a border between the first and second adjacent pixels, the black-insertion instruction section 32 corrects the image signal Vin to allow one of the first and second pixels to be maintained in black state of display for a predetermined period. The drive control section 34 controls operations of the horizontal drive circuit 12 and the vertical drive circuit 13 to perform display in the display region 10, based on the image signal corrected by the black-insertion instruction section 32.

[Operation of Liquid Crystal Display]

(Display of Moving Picture Causing Alignment Perturbation)

First, as a comparative example, display of a moving picture causing afterimage due to alignment perturbation will be described below.

Figure 5:
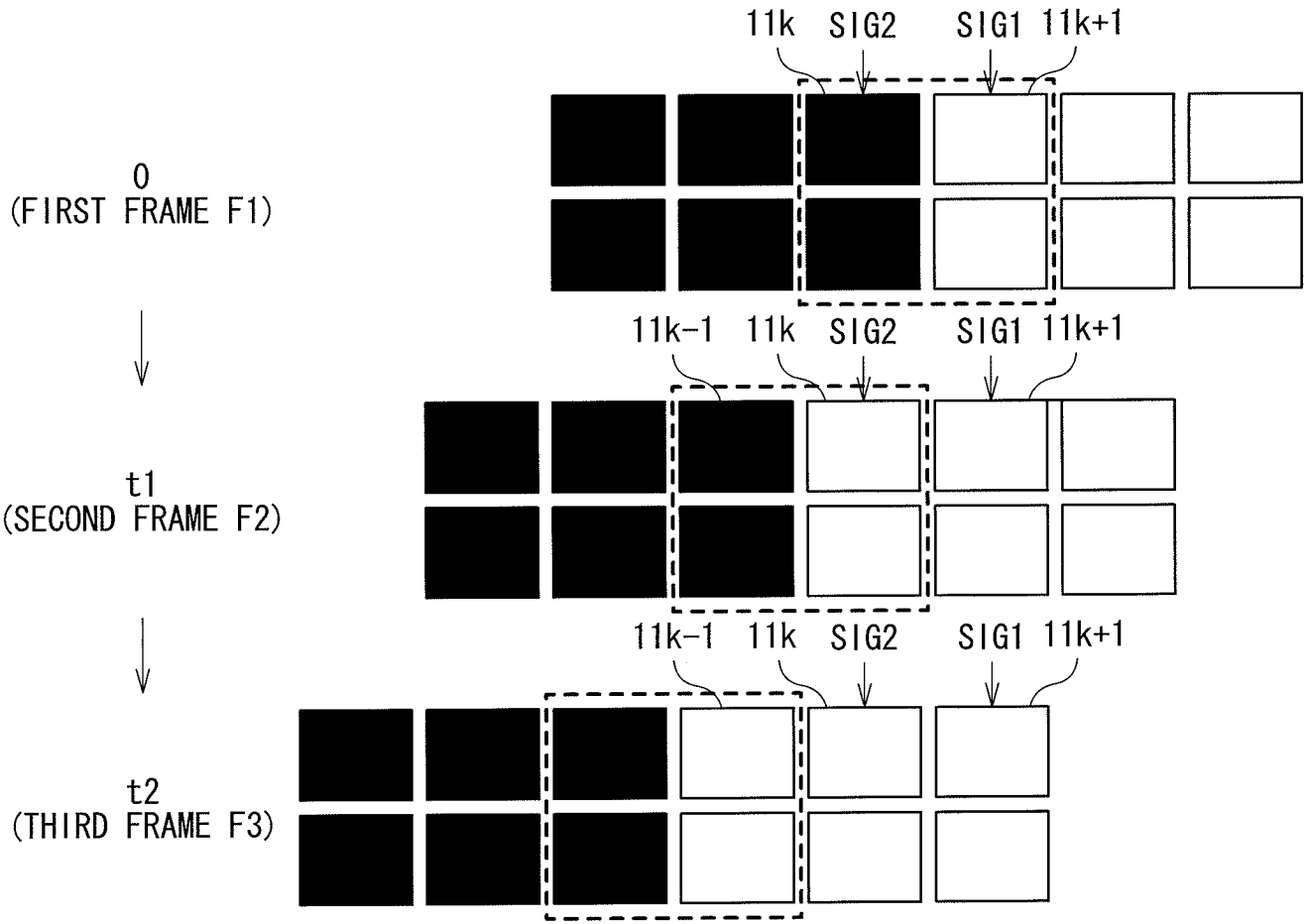
FIG. 5 RELATED ART
FIG. 5 is an explanatory diagram illustrating an example of display of a moving picture in respective pixels in a comparative example.
Figure 6:
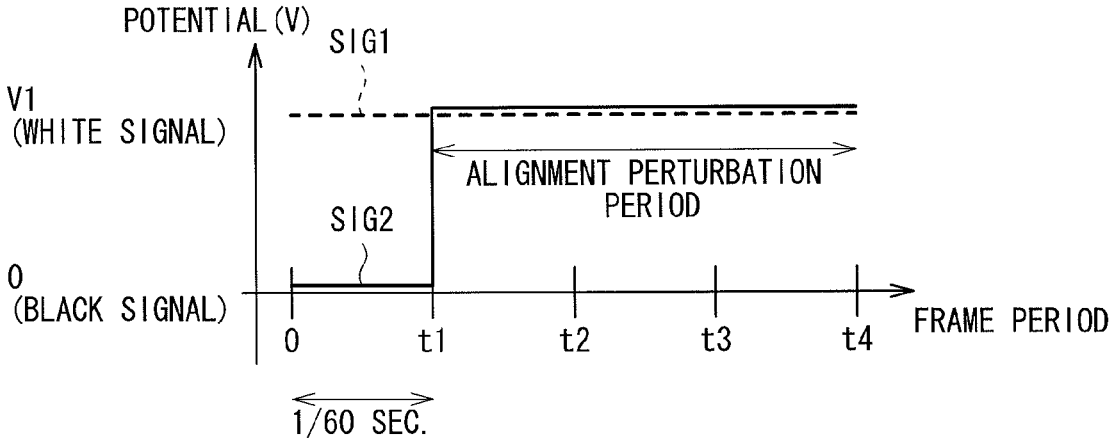
FIG. 6 RELATED ART
FIG. 6 is a waveform chart illustrating an example of a drive voltage in the comparative example.

For example, a case where a moving picture is displayed as illustrated in FIGS. 5 and 6 will be considered below. FIG. 5 illustrates a part of two rows of the pixels 11. Moreover, FIG. 5 schematically illustrates variations in gray scales of the pixels 11 when a first frame F1, a second frame F2, and a third frame F3 are sequentially displayed. An example in which there are a black display part and a white display part and a boundary position between the black display part and the white display part moves to allow a moving picture to be displayed is illustrated. For example, in the first frame F1, the boundary position between the black display part and the white display part is located between a kth pixel 11*k* and a k+1th pixel 11*k*+1 which are adjacent to each other. In subsequent frames, the boundary position between the black display part and the white display part moves to the lower left. FIG. 6 illustrates waveforms of a voltage SIG2 applied to the kth pixel 11*k* and a voltage SIG1 applied to the k+1th pixel 11*k*+1. It is to be noted that a potential difference between the pixel electrode 21 and the counter electrode 22 (refer to FIG. 2A) is 0 (V) in black state of display, and, for example, V1=4 (V) in white state of display.

Figure 7:
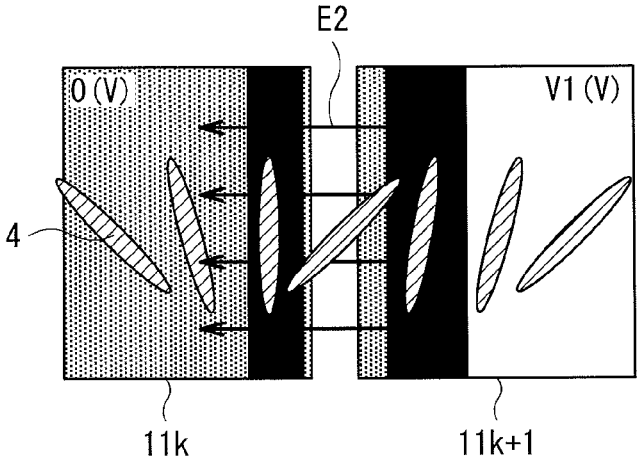
FIG. 7 RELATED ART
FIG. 7 is an explanatory diagram of alignment perturbation of liquid crystal molecules in the comparative example.

In the case where a moving picture illustrated in FIGS. 5 and 6 is displayed, as illustrated in FIG. 7, a transverse electric field E2 is generated in the boundary position between the black display part and the white display part to cause alignment perturbation of the liquid crystal molecules 4. In particular, alignment perturbation in which the liquid crystal molecules 4 fall in a direction opposite to the direction of the pre-tilt angle θ (refer to FIG. 3) occurs. It is to be noted that FIG. 7 illustrates a case where the boundary position between the black display part and the white display part is located between the kth pixel 11*k* and the k+1th pixel 11*k*+1. In FIG. 7, although the pixels 11*k* and 11*k*+1 are illustrated in plan, the liquid crystal molecules 4 are illustrated in section in a direction perpendicular to the plane of the pixels. In other words, for convenience sake, a state in which the pixels 11*k* and 11*k*+1 viewed from one direction and the liquid crystal molecules 4 viewed from another direction are superimposed on each other is illustrated.

In the case where the moving picture illustrated in FIGS. 5 and 6 is displayed, ideally, for example, the kth pixel 11*k* continuously is maintained in white state of display from the second frame F2 onward. However, as alignment perturbation illustrated in FIG. 7 continues from the second frame F2 onward, the liquid crystal molecules 4 are not in an alignment state corresponding to white display, thereby causing a decline in gray scale. In particular, when alignment perturbation in which the liquid crystal molecules 4 fall in a direction opposite to the direction of the pre-tilt angle θ (refer to FIG. 3) occurs, it takes long to put the liquid crystal molecules 4 into the alignment state corresponding to white display, and a decline in gray scale continues for a while.

The above-described display of a moving picture and issues thereof will be described in more detail below referring to FIGS. 8 to 11.

Figure 8:
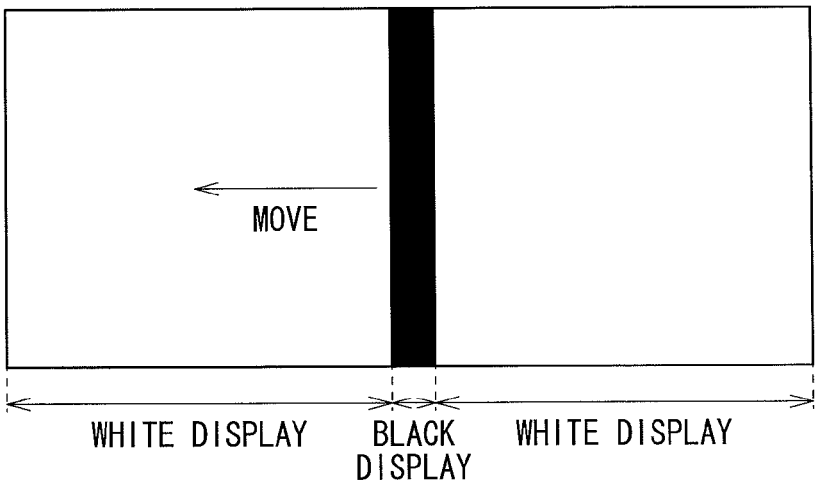
FIG. 8 RELATED ART
FIG. 8 is an explanatory diagram illustrating an example of display of a moving picture in the comparative example.
Figure 9:
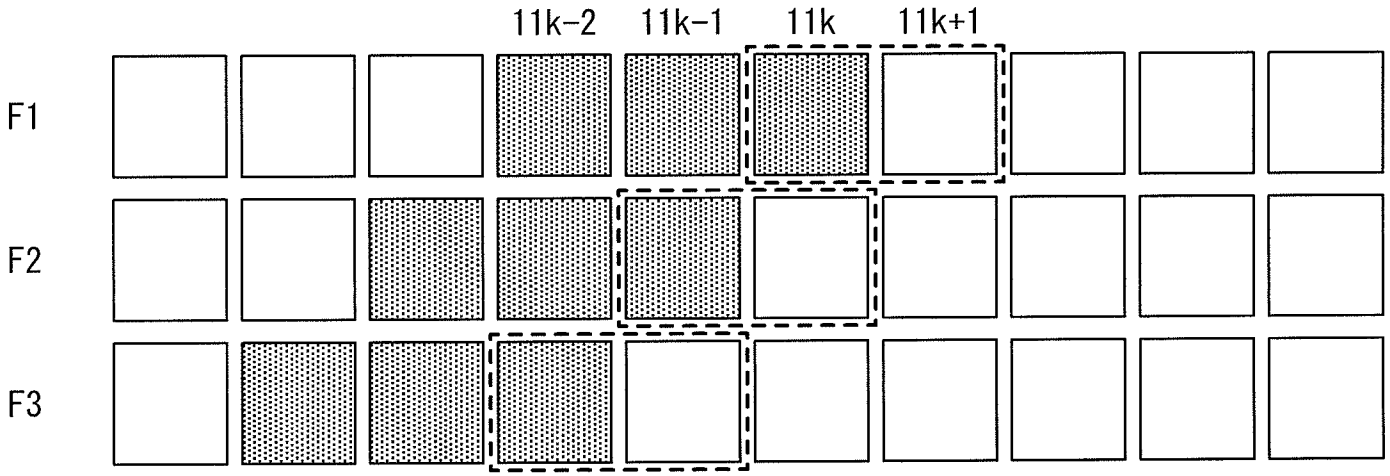
FIG. 9 RELATED ART
FIG. 9 is an explanatory diagram illustrating an example of display of a moving picture in respective pixels in the comparative example.

As illustrated in FIG. 8, a case where an image region in black state of display is included in a background image region in white state of display and the image region in black state of display moves to the left to allow a moving picture to be displayed will be described as an example. FIG. 9 illustrates a part of one arbitrary row of the pixels 11 when the moving picture illustrated in FIG. 8 is displayed. Moreover, FIG. 9 schematically illustrates variations in gray scales of the pixels 11 when the first frame F1, the second frame F2, and the third frame F3 are sequentially displayed. When such a moving picture is displayed, a boundary position between a black display part and a white display part moves to the left. For example, the boundary position between the black display part and the white display part is located between the kth pixel 11*k* and the k+1th pixel 11*k*+1 in the first frame F1, and between a k−1th pixel 11*k*−1 and the kth pixel 11*k* in the second frame F2 subsequent to the first frame F1.

Figure 10A:
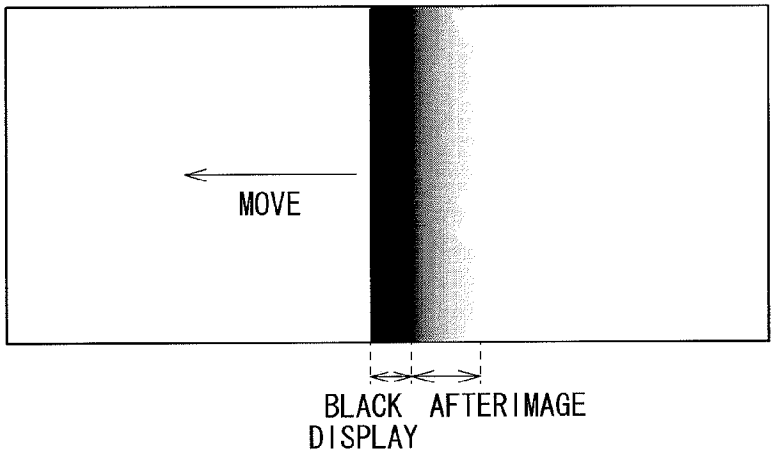
FIG. 10A RELATED ART
FIGS. 10A and 10B are an explanatory diagram illustrating an example of afterimage generated during display of a moving picture in the comparative example and an explanatory diagram illustrating alignment perturbation of liquid crystal molecules in respective pixels in the comparative example, respectively.
Figure 10B:
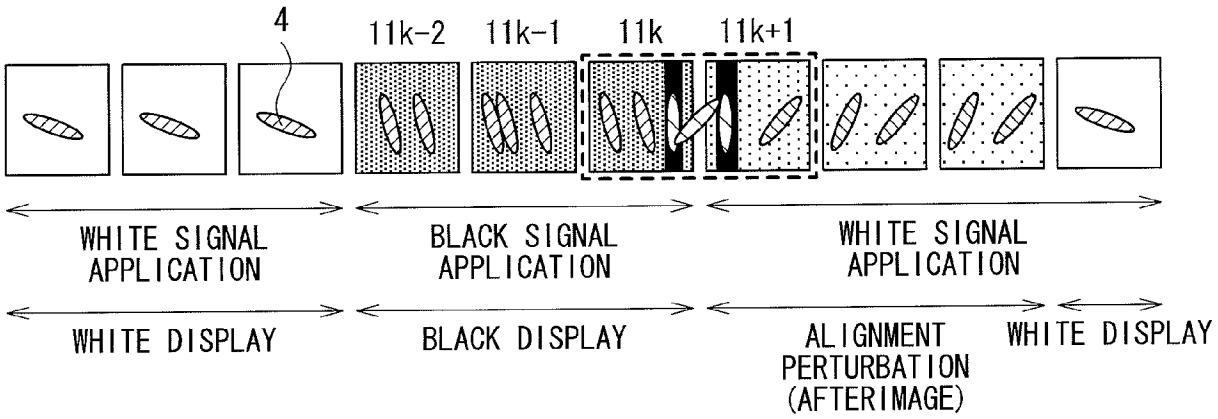
FIG. 10B RELATED ART
Figure 11:
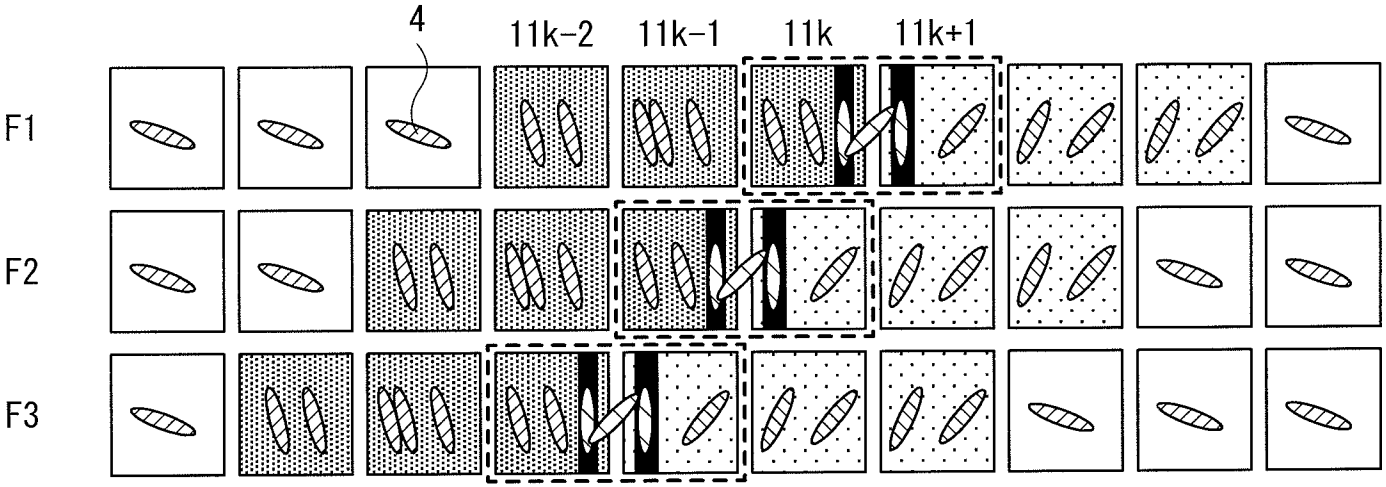
FIG. 11 RELATED ART
FIG. 11 is an explanatory diagram illustrating alignment perturbation of liquid crystal molecules in respective pixels in the comparative example.

FIGS. 10A, 10B, and 11 schematically illustrate afterimage caused when a moving picture is displayed as illustrated in FIG. 8. It is to be noted that, as in the case of FIG. 7, in FIGS. 10B and 11, the pixel 11*k* and other pixels are illustrated in plan, and the liquid crystal molecules 4 are illustrated in section in a direction perpendicular to the plane of the pixels. As described above referring to FIG. 7, the transverse electric field E2 is generated in the boundary position between the black display part and the white display part to cause alignment perturbation of the liquid crystal molecules 4. Therefore, as illustrated in FIGS. 10B and 11, in a few pixels on a right side of the boundary position between the black display part and the white display part, the liquid crystal molecules 4 are not in the alignment state corresponding to white display to cause a decline in gray scale, and a part corresponding to the pixels is observed as afterimage.

(Example of Improved Display of Moving Picture)

An example in which the above-described alignment perturbation is eliminated to improve display of a moving picture will be described below referring to FIGS. 12 to 14.

Figure 12:
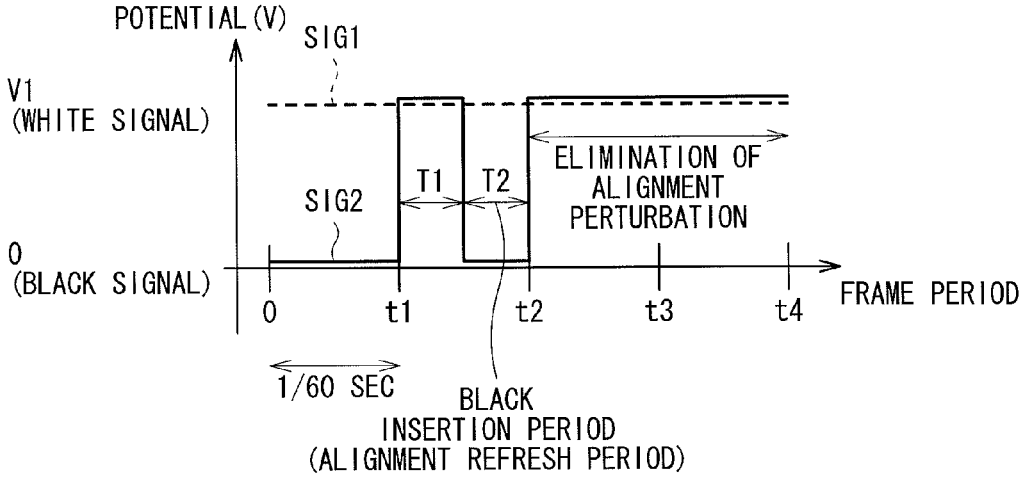
FIG. 12 is a waveform chart illustrating an example of a drive voltage in the liquid crystal display according to the first embodiment.

FIG. 12 illustrates a waveform of a drive voltage in improved display of a moving picture by eliminating alignment perturbation in the comparative example in FIG. 6. In the comparative example in FIG. 6, when the voltage SIG2 applied to the kth pixel 11*k* is continuously fixed at a white display potential from the second frame F2 onward, a period of the above-described alignment perturbation continues. Therefore, in a drive example in FIG. 12, after the kth pixel 11*k* is maintained in white state of display in a first period T1 of a first frame period in a sequence of white display frame periods, a black display period (an alignment refresh period) T2 is inserted to allow the kth pixel 11*k* to be maintained in black state of display for a predetermined period. As the alignment perturbation is eliminated by refreshing alignment in such a manner, normal white display is allowed to be performed in subsequent frames.

As a method of applying a drive voltage as illustrated in FIG. 12, for example, the following method is used. For example, one frame period (1/60 seconds) is divided into two sub-frame periods (1/120 seconds) by driving at 120 Hz. A first sub-frame period is a white display period and a second sub-frame period is the above-described black display period T2. In this case, the percentage of the black display period T2 in one frame period is 50%. In a similar method, one frame period (1/60 seconds) is divided into four sub-frame periods (1/240 seconds) by driving at 240 Hz. For example, first two sub-frame periods or first three sub-frames periods are white display periods, and last two sub-frame periods or the last sub-frame period is the above-described black display period T2. In this case, the percentage of the black display period T2 in one frame period is 50% or 25%. The frame period may be divided by a so-called double-speed drive or a so-called quad-speed drive, or a so-called reverse drive in which polarity of a drive voltage is reversed at regular intervals.

Figure 13:
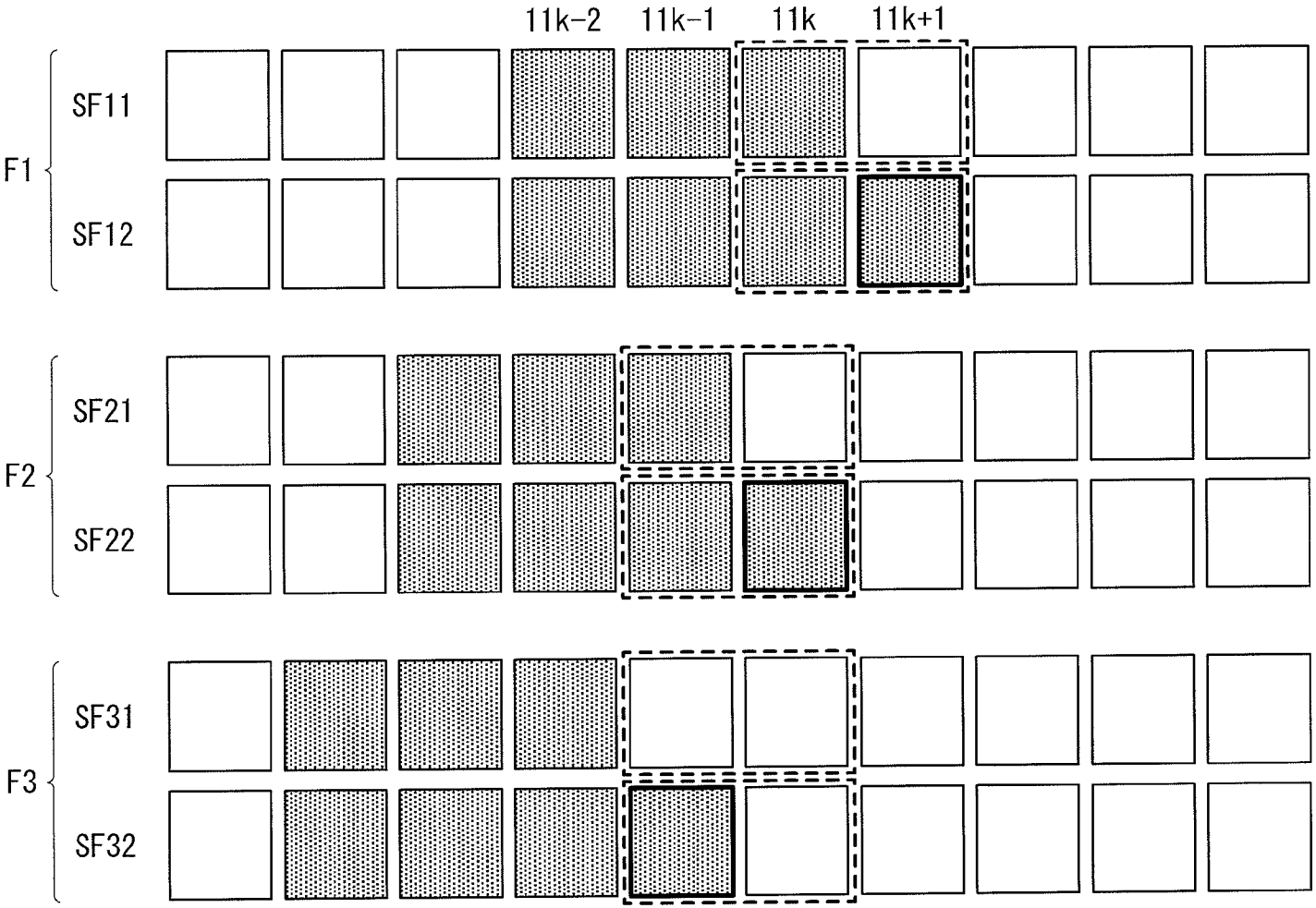
FIG. 13 is an explanatory diagram illustrating an example of display of a moving picture in respective pixels.
Figure 14:
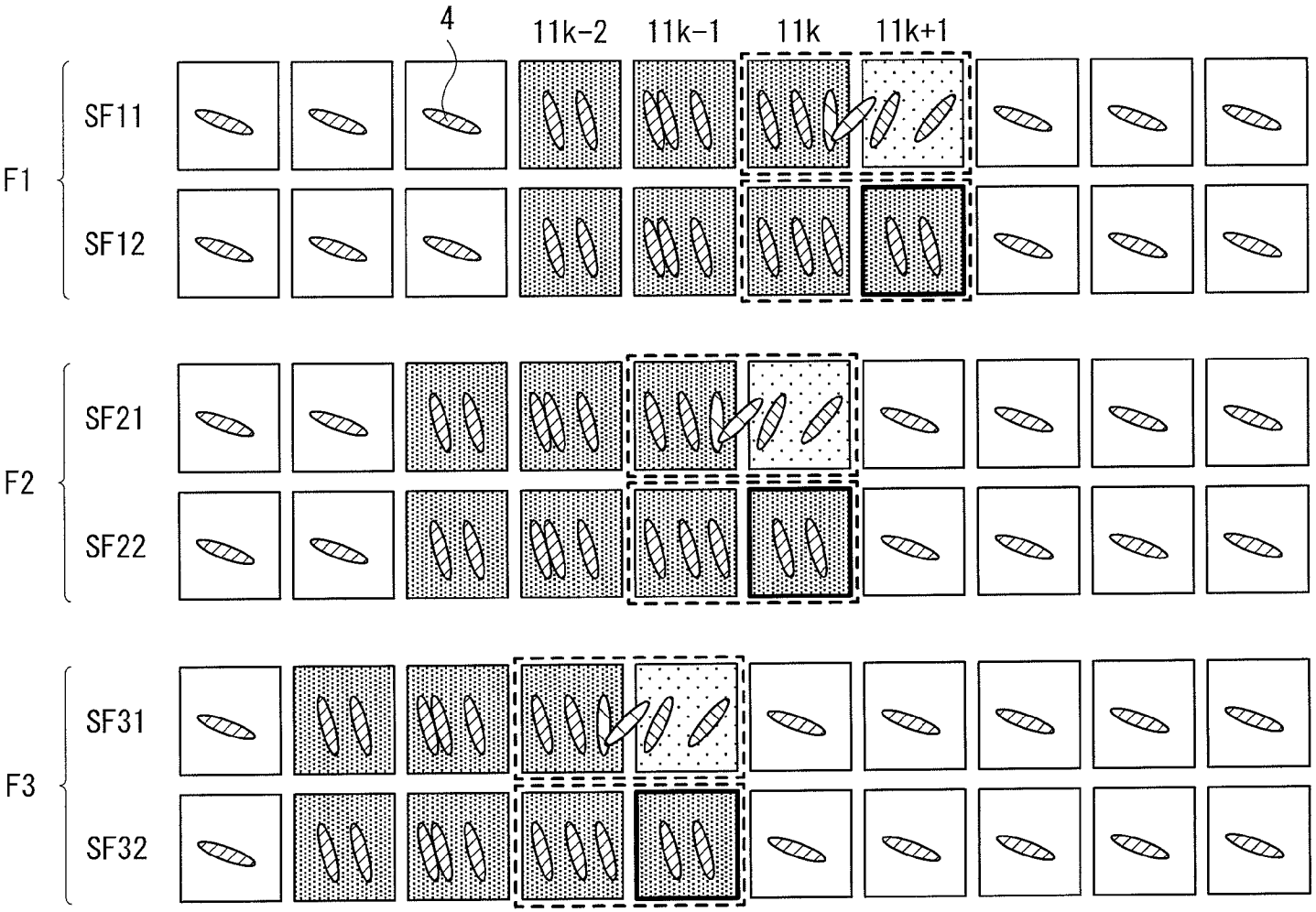
FIG. 14 is an explanatory diagram illustrating a method of suppressing alignment perturbation of liquid crystal molecules during display of a moving picture.

FIGS. 13 and 14 illustrate an example of improved display of a moving picture by improving the above-described display method in the comparative example illustrated in FIG. 11 and the like. It is to be noted that, as in the case of FIG. 7, in FIG. 14, the pixel 11*k* and the like are illustrated in plan, and the liquid crystal molecules 4 are illustrated in section in a direction perpendicular to the plane of the pixels. In the example of improved display of a moving picture, one frame period (1/60 seconds) is divided into two sub-frame periods (1/120 seconds), and the black display period T2 is allowed to be inserted into a second sub-frame period. For example, a 2−1th sub-frame SF21 and a 2−2th sub-frame SF22 into which the second frame F2 is divided are displayed. Therefore, for example, the kth pixel 11*k* is maintained in white state of display in the 2−1th sub-frame SF21 in a display period of the second frame F2, and then is maintained in black state of display in the 2−2th sub-frame SF22 subsequent to the 2−1th sub-frame SF21 to refresh alignment. The kth pixel 11*k* is maintained in normal white state of display in subsequent frames by refreshing alignment to eliminate alignment perturbation. Afterimage on an entire screen is allowed to be reduced by performing a similar process on other pixels.

Figure 4:
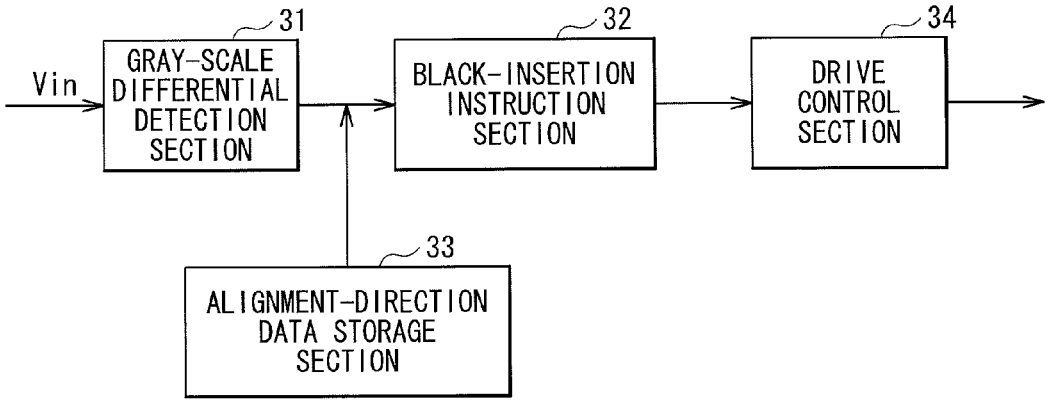
FIG. 4 is a block diagram illustrating a configuration example of a control circuit for suppressing alignment perturbation.

The control circuit illustrated in FIG. 4 performs the following operation to perform display of a moving picture illustrated in FIGS. 12 to 14. The gray-scale differential detection section 31 detects, based on the supplied image signal Vin, variations in gray scales of the first pixel and the second pixel which are adjacent to each other. The black-insertion instruction section 32 corrects an image signal, based on a detection result of the gray-scale differential detection section 31, to allow one of the first and second adjacent pixels in the plurality of pixels 11 to be maintained in black state of display for a predetermined period. The black-insertion instruction section 32 also corrects the image signal Vin in consideration of information of the direction of the pre-tilt angle θ from the alignment-direction data storage section 33. For example, when it is indicated that alignment perturbation of liquid crystal molecules 4 in a direction opposite to the direction of the pre-tilt angle θ as illustrated in FIG. 7 is likely to be caused in a region near a border between the first and second adjacent pixels, the black-insertion instruction section 32 corrects the image signal Vin to allow one of the first and second pixels to be maintained in black state of display for a predetermined period.

More specifically, in the case where the first pixel is maintained in black state of display and the second pixel is maintained in white state of display, in the first frame period, and both are maintained in white state of display in the second frame period subsequent to the first frame period, the black-insertion instruction section 32 performs correction to insert the black display period into the first frame period through allowing the second pixel in the first frame period to be maintained white state of display and then to be maintained in black state of display for a predetermined period. In an example illustrated in FIGS. 13 and 14, when display periods of the second frame F2 and the third frame F3 are considered as the first frame period and the second frame period, respectively, the k−1th pixel 11*k*−1 and the kth pixel 11*k* are the first pixel and the second pixel, respectively, and the kth pixel 11*k* is maintained in black state of display in the 2−2-th sub-frame SF22 to refresh alignment.

[Effects]

As described above, in the liquid crystal display according to the embodiment, one of the first pixel and the second pixel which are adjacent to each other is maintained in black state of display for a predetermined period, based on variations in gray scale; therefore, alignment perturbation of the liquid crystal molecules 4 during display of a moving picture is allowed to be suppressed, and the moving picture is allowed to be displayed with less afterimage. In particular, in the embodiment, instead of providing a black display period in which the entire screen is maintained in black state of display, only a specific pixel in which alignment perturbation occurs is maintained in black state of display; therefore, afterimage is allowed to be reduced while maintaining a natural display state without darkening the entire screen.

Second Embodiment

Next, a liquid crystal display according to a second embodiment of the disclosure will be described below. It is to be noted that like components are denoted by like numerals as of the liquid crystal display according to the first embodiment and will not be further described.

Figure 15:
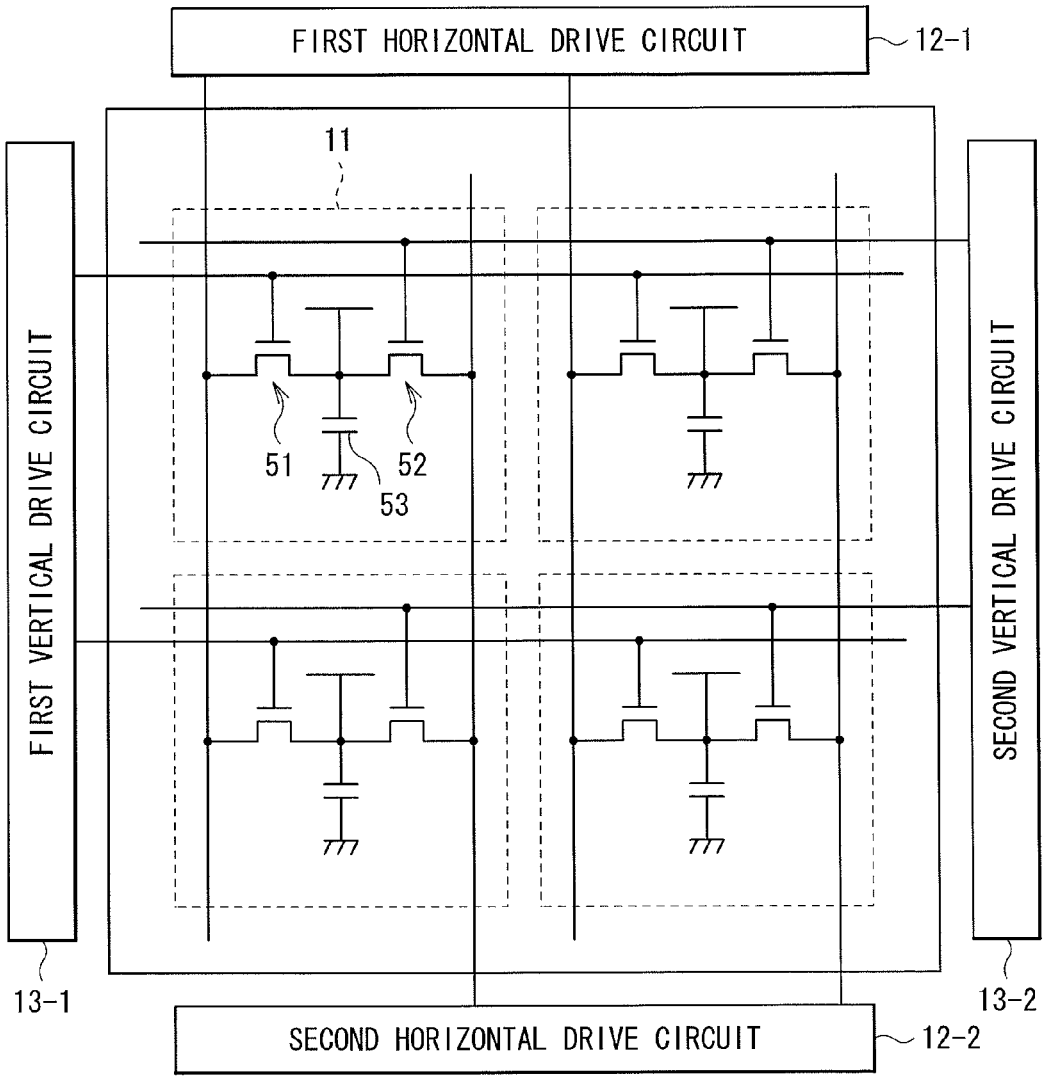
FIG. 15 is a block diagram illustrating a configuration example of a liquid crystal display according to a second embodiment of the disclosure.

FIG. 15 illustrates a configuration example of the liquid crystal display according to the second embodiment of the disclosure. It is to be noted that FIG. 15 illustrates only four pixels 11 as representatives.

In the embodiment, the liquid crystal display has a configuration similar to the configuration in FIG. 1, except that two circuits, i.e., a first horizontal drive circuit 12-1 and a second horizontal drive circuit 12-2 are included instead of one horizontal drive circuit 12, and two circuits i.e., a first vertical drive circuit 13-1 and a second vertical drive circuit 13-2 are included instead of one vertical drive circuit 13.

The pixels 11 each include a first transistor 51 and a second transistor 52 each configured of a TFT, and a liquid crystal capacitor 53. The first transistor 51 is connected to the first horizontal drive circuit 12-1 and the first vertical drive circuit 13-1, and is driven by the first horizontal drive circuit 12-1 and the first vertical drive circuit 13-1, and the second transistor 52 is connected to the second horizontal drive circuit 12-2 and the second vertical drive circuit 13-2, and is driven by the second horizontal drive circuit 12-2 and the second vertical drive circuit 13-2.

The first horizontal drive circuit 12-1 and the second horizontal drive circuit 12-2 are allowed to supply, in a horizontal direction, image data signals (gray-scale signals) based on an image signal to the plurality of pixels 11, independently of each other. The first vertical drive circuit 13-1 and the second vertical drive circuit 13-2 are allowed to supply, in a vertical direction, a gate signal (a scanning signal) to the plurality of pixels 11, independently of each other.

In the embodiment, two groups of drive circuits are included; therefore, when one group of drive circuits (for example, the second horizontal drive circuit 12-2 and the second vertical drive circuit 13-2) is used as circuits for inserting the above-described black display period T2 illustrated in FIGS. 12 to 14, the black display period T2 is allowed to be inserted into an arbitrary period. For example, in one frame period, image display is performed with use of the first horizontal drive circuit 12-1 and the first vertical drive circuit 13-1, and then image display is performed with use of the second horizontal drive circuit 12-2 and the second vertical drive circuit 13-2. One of the first pixel and the second pixel is controlled with use of the second horizontal drive circuit 12-2 and the second vertical drive circuit 13-2 to be maintained in black state of display for a predetermined period.

Third Embodiment

Next, a liquid crystal display according to a third embodiment of the disclosure will be described below. It is to be noted that like components are denoted by like numerals as of the liquid crystal display according to the first or second embodiment and will not be further described.

Figure 16:
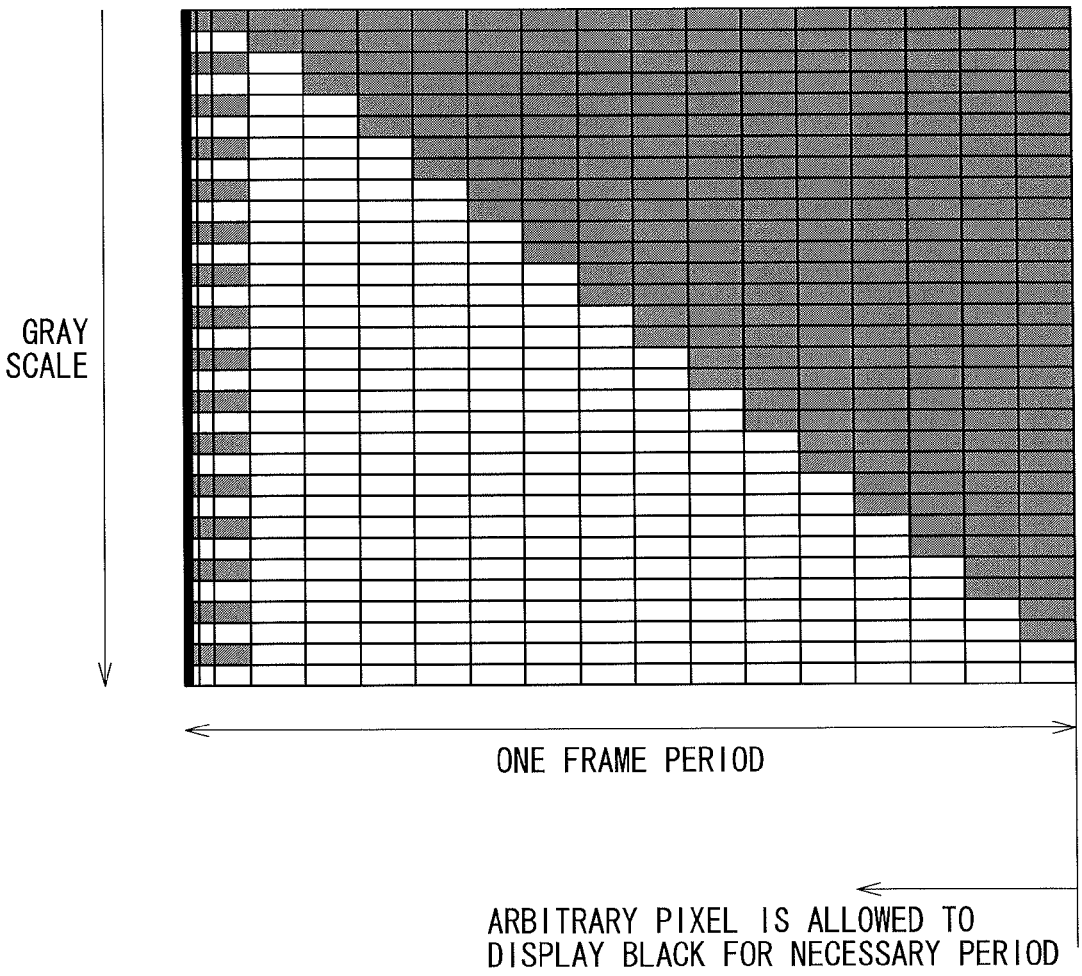
FIG. 16 is an explanatory diagram illustrating an example of drive display of pixels in a liquid crystal display according to a third embodiment of the disclosure.

Display of a moving picture illustrated in FIGS. 12 to 14 is applicable to a case where a digital drive in which a gray scale is displayed by pulse width modulation (PWM) is performed. In the digital drive, for example, one frame period is divided into a plurality of sub-field periods with different lengths, and a gray scale of a pixel is displayed by a combination of a plurality of gray-scale data with different periods. FIG. 16 illustrates an example of the digital drive for achieving display of the moving picture illustrated in FIGS. 12 to 14. In FIG. 16, the gray-scale level of an uppermost part is 0 (black), and the gray-scale of a lowermost part is maximum (white). In each gray-scale level other than the maximum gray-scale level, a black display period is inevitably located in a later part of one frame period. Therefore, an arbitrary period in the later part of one frame period is allowed to be a black display period.

Other Embodiments

The technology of the present disclosure is not limited to the above-described embodiments, and may be variously modified. For example, the liquid crystal displays according to the above-described respective embodiments are applicable to various electronic units having a display function. The liquid crystal displays according to the above-described respective embodiments are applicable to, for example, televisions, personal computers, and the like.

The present technology may have the following configurations.

(1) A liquid crystal display including:

a display section including a plurality of pixels and displaying an image through varying a gray scale of each of the pixels based on an image signal;

a detection section detecting, based on the image signal, variations in gray scales of a first pixel and a second pixel which are adjacent to each other; and a control section performing control, based on a detection result of the detection section, to allow one of the first and second pixels to be maintained in black state of display for a predetermined period.

(2) The liquid crystal display according to (1), further including a storage section configured to hold information of pre-tilt orientation of liquid crystal molecules in each of the pixels, the liquid crystal molecules being contained in a liquid crystal layer provided in the display section and being vertically aligned at a predetermined pre-tilt angle, in which the control section performs control, based on both the information of pre-tilt orientation and a detection result of the detection section, to allow the one of the first and second pixels to be maintained in black state of display for the predetermined period.

(3) The liquid crystal display according to (2), in which the control section performs control to allow the one of the first and second pixels to be maintained in black state of display for the predetermined period, when the information of pre-tilt orientation and the detection result of the detection section indicate that alignment perturbation of the liquid crystal molecules in an orientation opposite to the pre-tilt orientation is likely to be caused in a region near a border between the first pixel and the second pixel.

(4) The liquid crystal display according to any one of (1) to (3), in which the control section performs control to allow the one of the first and second pixels to be maintained in black state of display for the predetermined period, when an image region in black state of display is included in a background image region in white state of display and the image region in black state of display moves to allow a moving picture to be displayed.

(5) The liquid crystal display according to any one of (1) to (4), in which the control section performs control to insert a black display period into a first frame period through allowing the second pixel in the first frame period to be maintained in white state of display and then to be maintained in black state of display for the predetermined period, when the first pixel is maintained black state of display and the second pixel is maintained in white state of display in the first frame period, and when both the first and second pixels are maintained in white state of display in a second frame period subsequent to the first frame period.

(6) The liquid crystal display according to (5), further including:

a first horizontal drive circuit supplying, in a horizontal direction, gray-scale signals based on the image signal to the plurality of pixels;

a second horizontal drive circuit supplying, in a horizontal direction, the gray-scale signals to the plurality of pixels, independently of the first horizontal drive circuit;

a first vertical drive circuit supplying, in a vertical direction, a scanning signal to the plurality of pixels; and a second vertical drive circuit supplying, in a vertical direction, the scanning signal to the plurality of pixels, independently of the first vertical drive circuit, in which the first pixel and the second pixel are controlled, in one frame period, to allow image display to be performed with use of the first horizontal drive circuit and the first vertical drive circuit and then to be performed with use of the second horizontal drive circuit and the second vertical drive circuit, and the control section performs control to allow the one of the first and second pixels to be maintained in black state of display for the predetermined period with use of the second horizontal drive circuit and the second vertical drive circuit.

(7) A method of driving a liquid crystal display, the liquid crystal display including a display section including a plurality of pixels and displaying an image through varying a gray scale of each of the pixels based on an image signal; the method including:

detecting, based on the image signal, variations in gray scales of a first pixel and a second pixel which are adjacent to each other; and performing control, based on a detection result on variations in gray scale, to allow one of the first and second pixels to be maintained in black state of display for a predetermined period.

(8) An electronic unit including a liquid crystal display, the liquid crystal display including:

a display section including a plurality of pixels and displaying an image through varying a gray scale of each of the pixels based on an image signal;

a detection section detecting, based on the image signal, variations in gray scales of a first pixel and a second pixel which are adjacent to each other; and a control section performing control, based on a detection result of the detection section, to allow one of the first and second pixels to be maintained in black state of display for a predetermined period.

The present application claims priority to Japanese Priority Patent Application No. 2011-205987 filed in the Japan Patent Office on Sep. 21, 2011, the entire content of which is hereby incorporated by reference.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A liquid crystal display comprising:

a display section including a plurality of pixels and displaying an image through varying a gray scale of each of the pixels based on an image signal;

a detection section detecting, based on the image signal, variations in gray scales of a first pixel and a second pixel which are adjacent to each other;

a control section performing control, based on a detection result of the detection section, to allow one of the first and second pixels to be maintained in black state of display for a predetermined period; and a storage section configured to hold information of pre-tilt orientation of liquid crystal molecules in each of the pixels, the liquid crystal molecules being contained in a liquid crystal layer provided in the display section and being vertically aligned at a predetermined pre-tilt angle, wherein the control section performs control, based on both the information of pre-tilt orientation and a detection result of the detection section, to allow the one of the first and second pixels to be maintained in black state of display for the predetermined period, and wherein the control section performs control to allow the one of the first and second pixels to be maintained in black state of display for the predetermined period, when the information of pre-tilt orientation and the detection result of the detection section indicate that alignment perturbation of the liquid crystal molecules in an orientation opposite to the pre-tilt orientation is likely to be caused in a region near a border between the first pixel and the second pixel.

2. The liquid crystal display according to claim 1, wherein the control section performs control to allow the one of the first and second pixels to be maintained in black state of display for the predetermined period, when an image region in black state of display is included in a background image region in white state of display and the image region in black state of display moves to allow a moving picture to be displayed.

3. The liquid crystal display according to claim 1, wherein the control section performs control to insert a black display period into a first frame period through allowing the second pixel in the first frame period to be maintained in white state of display and then to be maintained in black state of display for the predetermined period, when the first pixel is maintained black state of display and the second pixel is maintained in white state of display in the first frame period, and when both the first and second pixels are maintained in white state of display in a second frame period subsequent to the first frame period.

4. The liquid crystal display according to claim 3, further comprising:

a first horizontal drive circuit supplying, in a horizontal direction, gray-scale signals based on the image signal to the plurality of pixels;

a second horizontal drive circuit supplying, in a horizontal direction, the gray-scale signals to the plurality of pixels, independently of the first horizontal drive circuit;

a first vertical drive circuit supplying, in a vertical direction, a scanning signal to the plurality of pixels; and a second vertical drive circuit supplying, in a vertical direction, the scanning signal to the plurality of pixels, independently of the first vertical drive circuit, wherein the first pixel and the second pixel are controlled, in one frame period, to allow image display to be performed with use of the first horizontal drive circuit and the first vertical drive circuit and then to be performed with use of the second horizontal drive circuit and the second vertical drive circuit, and the control section performs control to allow the one of the first and second pixels to be maintained in black state of display for the predetermined period with use of the second horizontal drive circuit and the second vertical drive circuit.

5. A method of driving a liquid crystal display, the liquid crystal display including a display section including a plurality of pixels and displaying an image through varying a gray scale of each of the pixels based on an image signal; the method comprising:

detecting, based on the image signal, variations in gray scales of a first pixel and a second pixel which are adjacent to each other;

performing control, based on a detection result on variations in gray scale, to allow one of the first and second pixels to be maintained in black state of display for a predetermined period;

holding information of pre-tilt orientation of liquid crystal molecules in each of the pixels, the liquid crystal molecules being contained in a liquid crystal layer provided in the display section and being vertically aligned at a predetermined pre-tilt angle;

performing control, based on both the information of pre-tilt orientation and a detection result of the detection section, to allow the one of the first and second pixels to be maintained in black state of display for the predetermined period; and performing control to allow the one of the first and second pixels to be maintained in black state of display for the predetermined period, when the information of pre-tilt orientation and the detection result of the detection section indicate that alignment perturbation of the liquid crystal molecules in an orientation opposite to the pre-tilt orientation is likely to be caused in a region near a border between the first pixel and the second pixel.

6. An electronic unit including a liquid crystal display, the liquid crystal display comprising:

a display section including a plurality of pixels and displaying an image through varying a gray scale of each of the pixels based on an image signal;

a detection section detecting, based on the image signal, variations in gray scales of a first pixel and a second pixel which are adjacent to each other; and a control section performing control, based on a detection result of the detection section, to allow one of the first and second pixels to be maintained in black state of display for a predetermined period; and a storage section configured to hold information of pre-tilt orientation of liquid crystal molecules in each of the pixels, the liquid crystal molecules being contained in a liquid crystal layer provided in the display section and being vertically aligned at a predetermined pre-tilt angle, wherein the control section performs control, based on both the information of pre-tilt orientation and a detection result of the detection section, to allow the one of the first and second pixels to be maintained in black state of display for the predetermined period, and wherein the control section performs control to allow the one of the first and second pixels to be maintained in black state of display for the predetermined period, when the information of pre-tilt orientation and the detection result of the detection section indicate that alignment perturbation of the liquid crystal molecules in an orientation opposite to the pre-tilt orientation is likely to be caused in a region near a border between the first pixel and the second pixel.

* * * * *